US006827607B2

(12) United States Patent
Fujita et al.

(10) Patent No.: US 6,827,607 B2
(45) Date of Patent: Dec. 7, 2004

(54) CONNECTOR FOR CIRCUIT BOARD AND METHOD OF FORMING IT

(75) Inventors: Shinya Fujita, Yokkaichi (JP); Toshikazu Sakurai, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 64 days.

(21) Appl. No.: 10/406,962

(22) Filed: Apr. 3, 2003

(65) Prior Publication Data

US 2003/0190839 A1 Oct. 9, 2003

(30) Foreign Application Priority Data

Apr. 4, 2002 (JP) ..... 2002-102264

(51) Int. Cl.[7] ..... H01R 13/73
(52) U.S. Cl. ..... 439/573; 439/954
(58) Field of Search ..... 439/573, 954, 439/564

(56) References Cited

U.S. PATENT DOCUMENTS

| | | | | | |
|---|---|---|---|---|---|
| 3,323,768 | A | * | 6/1967 | Hennessey | 248/309.1 |
| 3,596,235 | A | * | 7/1971 | Teurlings | 439/748 |
| 4,640,566 | A | | 2/1987 | Matsusaka | |
| 5,194,019 | A | * | 3/1993 | Rose | 439/569 |
| 5,241,451 | A | * | 8/1993 | Walburn et al. | 361/785 |

* cited by examiner

*Primary Examiner*—Gary Paumen
(74) *Attorney, Agent, or Firm*—Gerald E. Hespos; Anthony J. Casella

(57) ABSTRACT

A housing (10) of a connector has vertical screw holes (14) parallel to a connecting direction of the housing (10) and horizontal screw holes (19) normal to the connecting direction. Thus, the housing (10) is both horizontally and vertically mountable on a circuit board (P), and flexibility in the use of the housing (10) is improved. Further, the horizontal screw holes (19) are normal to the connecting direction and can be formed by a pair of molds movable along the connecting direction. Therefore, costs necessary for the molds can be reduced.

16 Claims, 7 Drawing Sheets

CONNECTOR FOR CIRCUIT BOARD AND METHOD OF FORMING IT

BACKGROUND OF THE INVENTION

1. Field of the Invention

The invention relates to a connector for circuit board and to a method of forming a connector for circuit board.

2. Description of the Related Art

U.S. Pat. No. 4,640,566 and FIG. 7 herein disclose a connector for a circuit board. As shown in FIG. 7, this connector has a housing 1 formed of a synthetic resin and is used with a mating connector 2 that can be fit into a receptacle 3 formed in the front of the housing 1. Mounts 4 project at the left and right sides of the receptacle 3 and are formed respectively with screw holes 4A that penetrate the mounts 4 vertically along a direction normal to connecting direction. The housing 1 can be fixed to a circuit board (not shown) by screwing screws into the screw holes 4A so that the bottom surface of the housing 1 is held in close contact with the circuit board. L-shaped terminal fittings 5 are insert molded into the housing 1 and penetrate a back wall 3A of the receptacle 3 in forward and backward directions so that ends of the terminal fittings 5 are connectable with corresponding circuits on the circuit board. The connector is mounted horizontally so that the connecting direction of the housing 1 is parallel to the circuit board.

FIG. 8 shows a connector with a housing 6 that is mounted vertically so that the connecting direction of a housing 6 is normal to a circuit board P. This connector has mounts 8 that project at the opposite left and right sides of a receptacle 7. The housing 6 is fixed to the circuit board P by using screw holes 8A that are formed in the mounts 8 and extend along the connecting direction. Straight terminal fittings 9 penetrate a back wall 7A of the receptacle 7 and one end of each straight terminal fitting 9 is connected with a corresponding circuit on the circuit board P.

The present invention was developed in view of the above state of the art and an object of the invention is to provide a connector for circuit board, where the connector has improved flexibility in the use of a housing.

SUMMARY OF THE INVENTION

The invention relates to a connector for a circuit board. The connector includes a housing with a receptacle for receiving a mating connector. A first orientation-mounting screw hole is formed in the housing and extends at an angle to a connecting direction of the housing. The first orientation-mounting screw hole is adapted to cooperate with at least one screw to secure the housing to the circuit board in a first orientation. A second orientation-mounting screw hole also is formed in the housing and is adapted to cooperate with at least one screw to secure the housing to the circuit board in a second orientation different from the first orientation. At least one terminal mount hole penetrates a back wall of the receptacle and can receive at least two kinds of terminal fittings. Accordingly, the housing can be mounted on the circuit board in two orientations. This can improve flexibility in the use of the housing and can reduce costs.

The first orientation-mounting screw hole preferably is adapted to secure the housing to the circuit board so that the connecting direction is parallel to the circuit board.

The second orientation-mounting screw hole preferably is adapted to secure the housing to the circuit board in a second orientation so that the connecting direction is substantially normal to the circuit board.

The second orientation-mounting screw hole preferably extends substantially parallel to the connecting direction.

The terminal fittings preferably comprise a substantially L-shaped terminal fitting connectable with a circuit on the circuit board in the first orientation and a substantially straight terminal fitting connectable with the circuit on the circuit board in the second orientation.

A plurality of the terminal mount holes preferably are arranged along a widthwise direction of the receptacle and are aligned at an angle to the extension of the first orientation-mounting screw hole.

The first orientation-mounting screw hole preferably is at a substantially middle position between one sidewall of the receptacle and a terminal mount hole at an outermost side in the back wall of the receptacle.

A wall with a certain thickness must be provided around the screw hole to ensure its strength. However, the width of a housing must be larger if mounting portions formed with screw holes are formed outside a receptacle, as in the prior art. On the other hand, the space between the terminal mount holes must be wider if the screw hole is between a pair of the terminal mount holes in the back wall of the receptacle since a certain clearance is required between the screw hole and the terminal mount holes. As a result, the dimension of the housing becomes larger. However, in the present invention, the horizontal-mounting screw hole is near the sidewall of the receptacle. Thus, a part of the wall around the horizontal-mounting screw hole overlaps the sidewall with respect to the widthwise direction. Therefore, the housing can be made narrower by at least as much as the thickness of the sidewall.

The first orientation-mounting screw hole preferably has inner concave arcuate walls at a first side of the first orientation-mounting screw hole substantially facing mold-removal holes in the second side of the first orientation-mounting screw hole. Inner concave arcuate walls also are formed at the second side of the first orientation-mounting screw hole and face mold-removal holes in the first side of the first orientation-mounting screw hole. The arcuate surfaces are arranged alternately along a direction substantially normal to the connecting direction.

The horizontal-mounting screw hole is formed by a pair of molds that are movable along the connecting direction. Thus, there is no need to prepare separate molds that movable along directions normal to the connecting direction to form the horizontal-mounting screw hole.

The invention also relates a method of forming the above-described connector for a circuit board. The method comprises forming a first orientation-mounting screw hole in the housing to extend at an angle to a connecting direction of the housing so that the first orientation-mounting screw hole can secure the housing to the circuit board in a first orientation. The method also comprises forming a second orientation-mounting screw hole in the housing so that the second orientation-mounting screw hole can secure the housing to the circuit board in a second orientation different from the first orientation. The method also includes forming at least one terminal mount hole to penetrate a back wall of the receptacle for receiving at least two kinds of terminal fittings.

The first orientation-mounting screw hole may be formed to secure the housing with the connecting direction parallel to the circuit board.

The second orientation-mounting screw hole may be formed to secure the housing with the connecting direction substantially normal to the circuit board.

The second orientation-mounting screw hole is formed to extend substantially along a direction parallel to the connecting direction.

The method may comprise forming a plurality of the terminal mount holes along the widthwise direction of the receptacle and arranged at an angle to the first orientation-mounting screw hole.

The first orientation-mounting screw hole preferably is formed such that concave arcuate walls at a first side of the first orientation-mounting screw hole face mold-removal holes in the second side of the first orientation-mounting screw hole and concave arcuate walls at the second side of the first orientation-mounting screw hole face mold-removal holes in the first side of the first orientation-mounting screw hole. The inner arcuate walls are arranged alternately along a direction arranged at an angle to the connecting direction.

The housing is formed by two molds closeable along the connecting direction. Each mold is formed with at least one pin for forming the concave arcuate walls of the first orientation-mounting screw hole. The pins on one mold preferably are arranged alternately with the pins on the other mold.

These and other features of the invention will become more apparent upon reading of the following detailed description of preferred embodiments and accompanying drawings. It should be understood that even though embodiments are described separately, single features may be combined to additional embodiments.

DETAILED DESCRIPTION OF THE PREFERRED EMBODIMENTS

Figure 1:
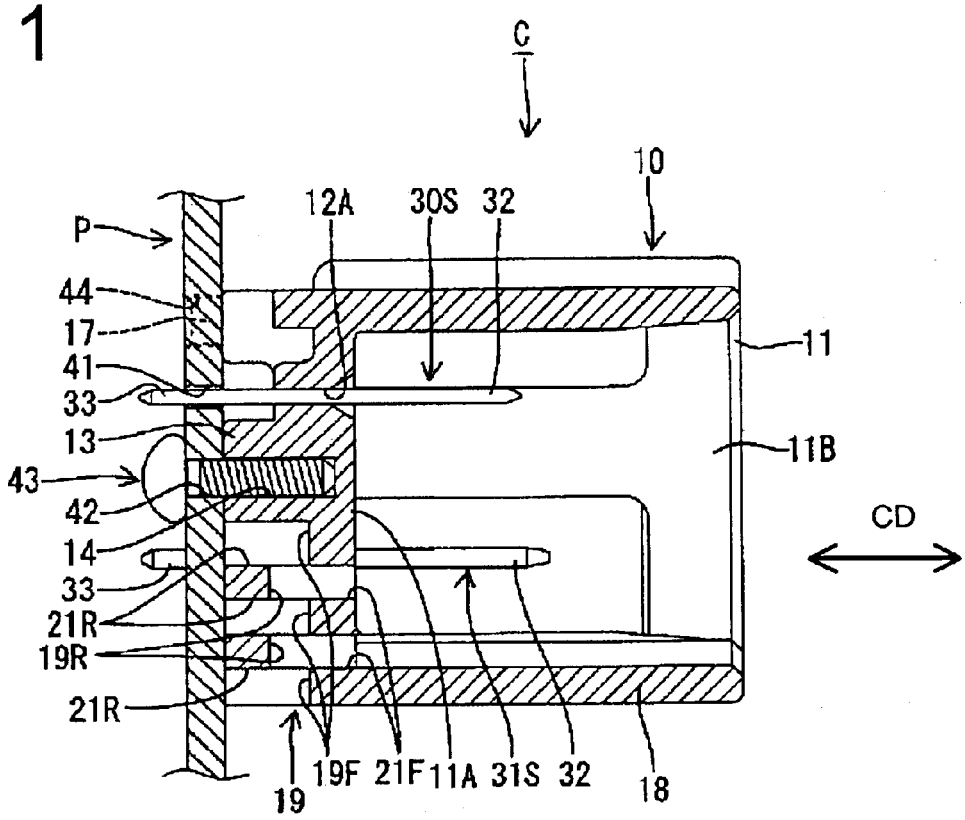
FIG. 1 is a side sectional view of a connector according to one embodiment of the present invention showing a state where the connector is vertically mounted on a circuit board.
Figure 2:
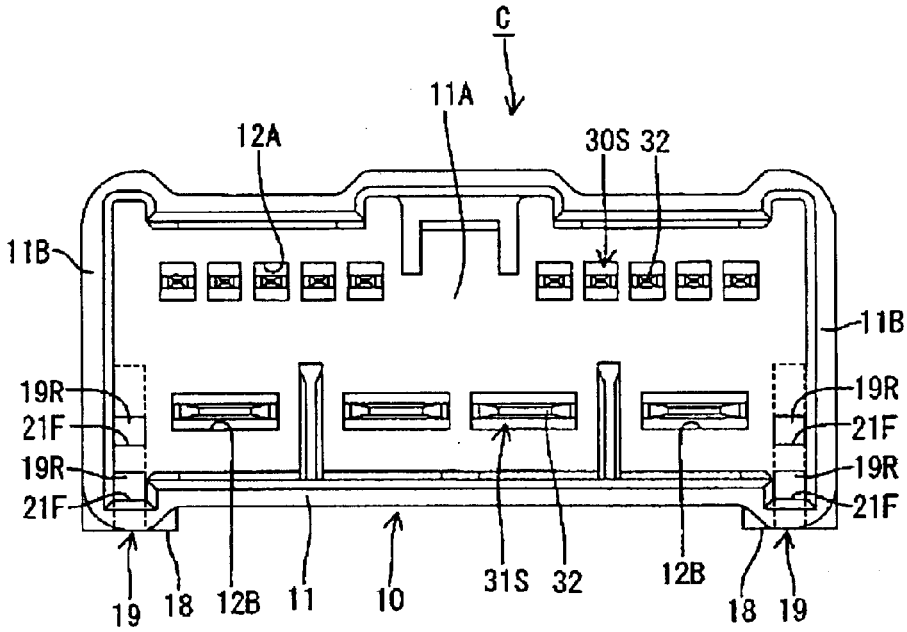
FIG. 2 is a front view of the connector.
Figure 6:
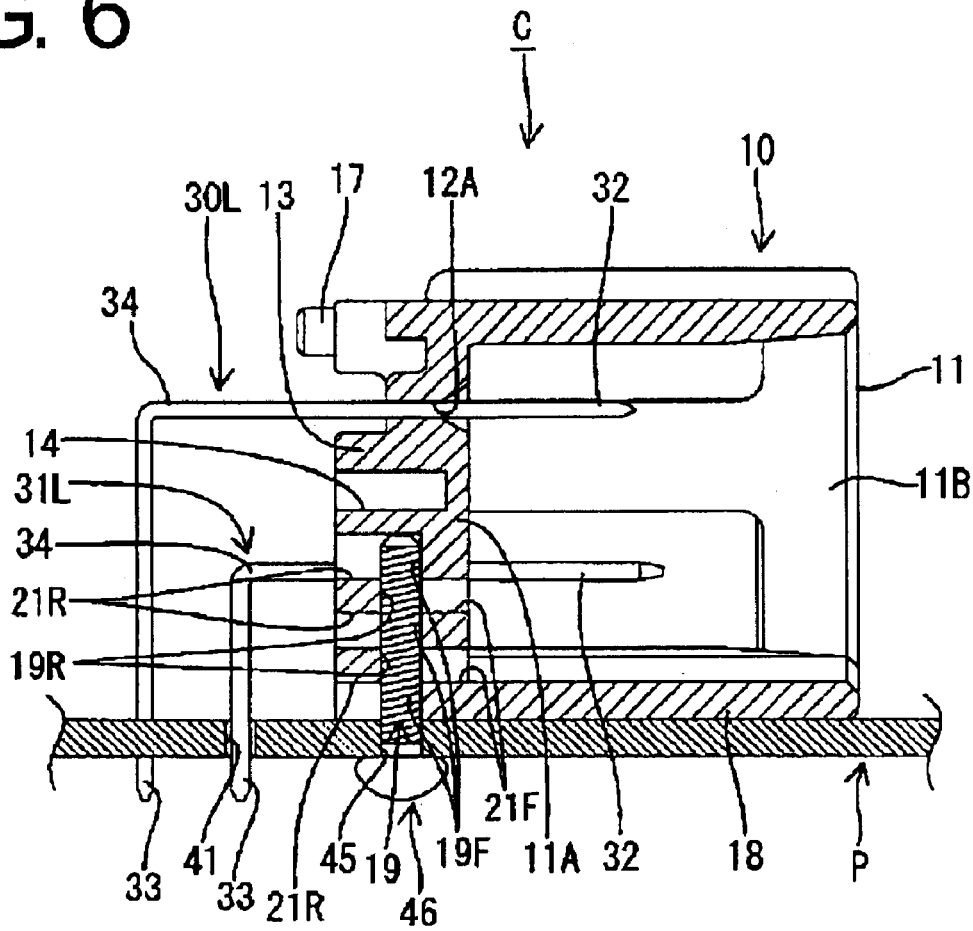
FIG. 6 is a side sectional view showing a state where the connector is horizontally mounted on the circuit board.
Figure 7:
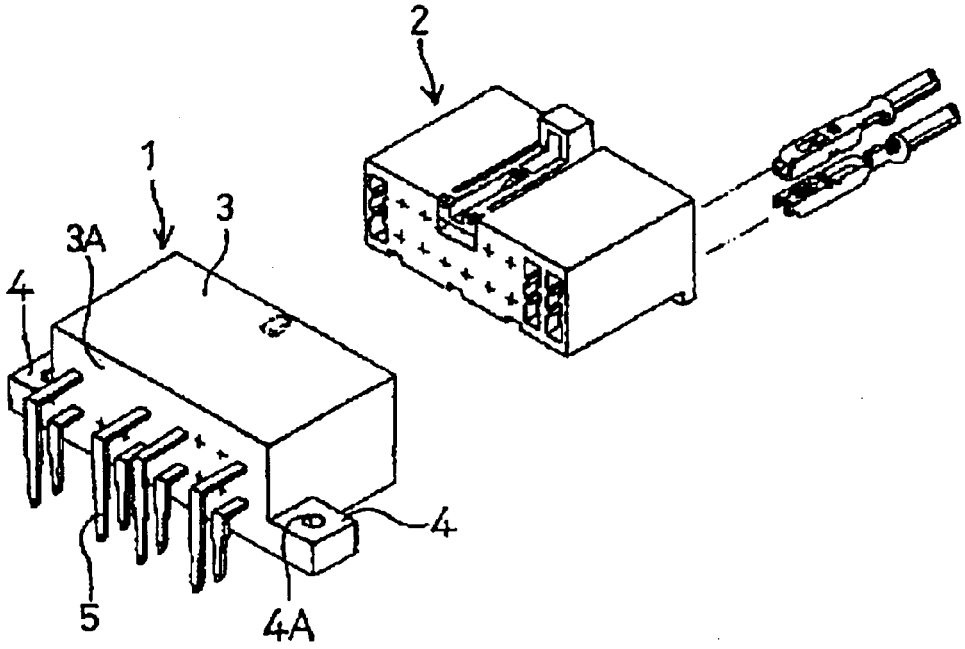
FIG. 7 PRIOR ART
FIG. 7 is a perspective view of a prior art connector showing a state where the connector is horizontally mounted on a circuit board.
Figure 8:
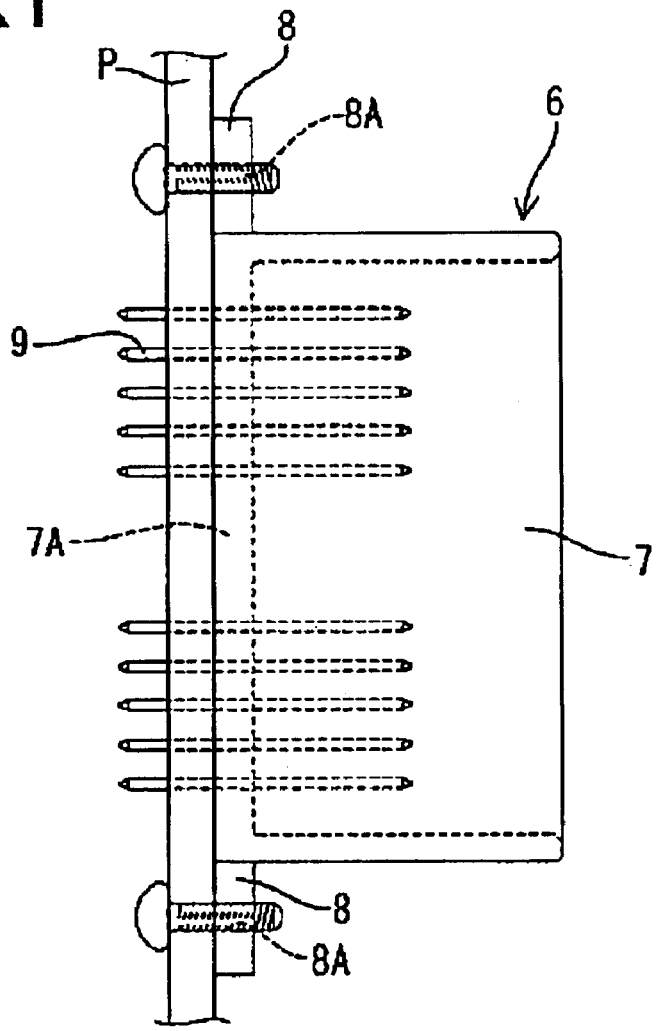
FIG. 8 PRIOR ART
FIG. 8 is a plan view of another prior art connector showing a state where the connector is vertically mounted on a circuit board.

The letter C in FIGS. 1 to 4 and 6 identifies a connector according to the invention. The connector C includes a housing 10 that is mountable on a circuit board P. In the following description, a side of the housing 10 that can be mated with a mating connector (not shown), e.g. right side in FIGS. 1 and 6, is referred to as the front side, and reference is made to FIGS. 1 and 6 concerning the vertical direction.

The housing 10 is formed e.g. of a synthetic resin and has a wide rectangular tubular receptacle 11 with a back wall 11A and an open front, as shown in FIGS. 1 to 4. A mating female connector (not shown) is fittable into the receptacle 11 at the open front end. Large and small terminal mount holes 12A, 12B penetrate the back wall 11A of the receptacle 11 along forward and backward directions. The small terminal mount holes 12A are arranged substantially along a widthwise direction at an upper part of the back wall 11A, and the straight terminal fittings 30S or the L-shaped terminal fittings 30L can be pressed through the small terminal mount holes 12A from the front. The large terminal mount holes 12B are arranged substantially along the widthwise direction at a lower part of the back wall 11A, and the straight terminal fittings 31S or the L-shaped terminal fittings 31L can be pressed through the large terminal mount holes 12B from the front.

Figure 4:
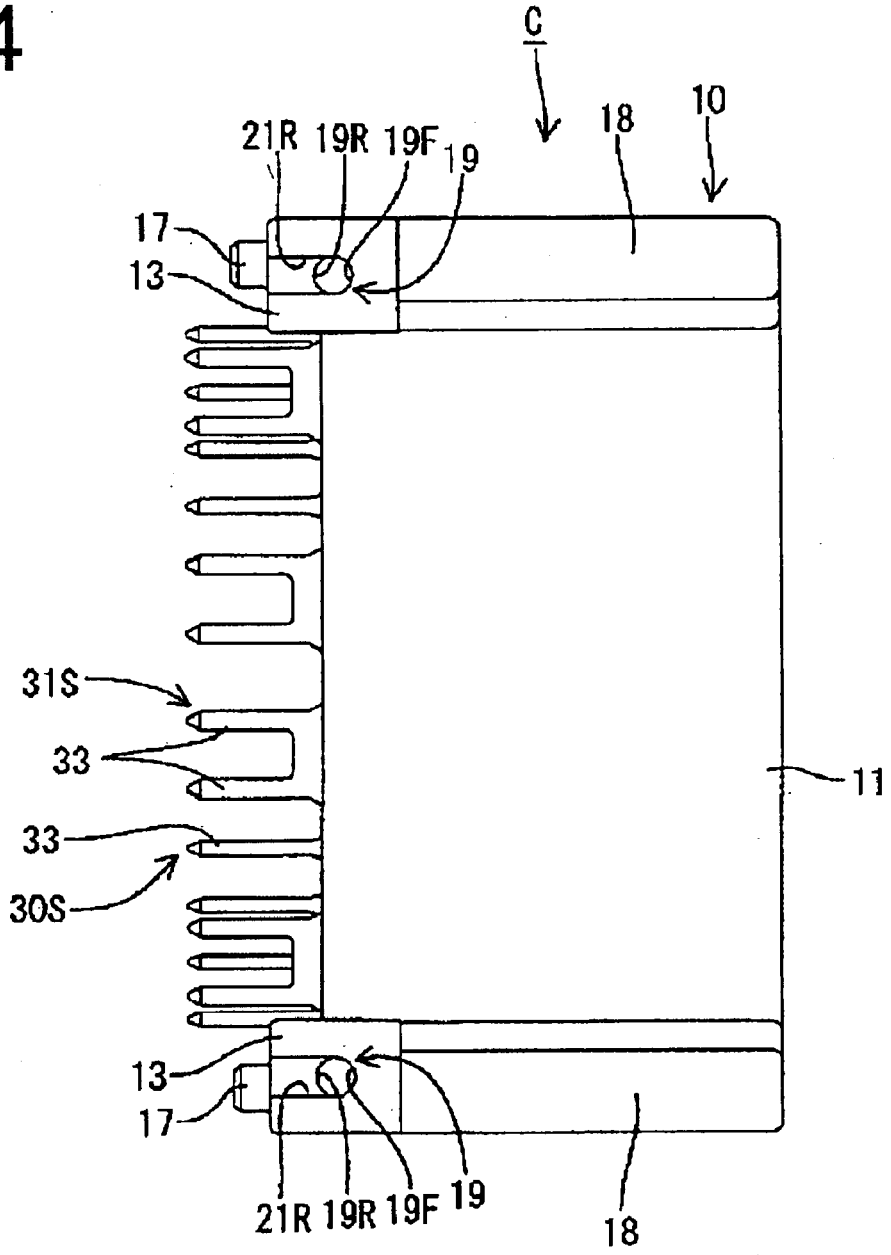
FIG. 4 is a bottom view of the connector.
Figure 5A:
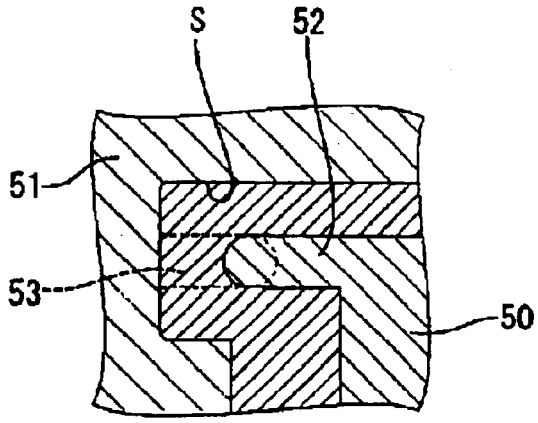
FIG. 5(A) is a sectional plan view of a portion around a horizontal-mounting screw hole with molds closed.
Figure 5B:
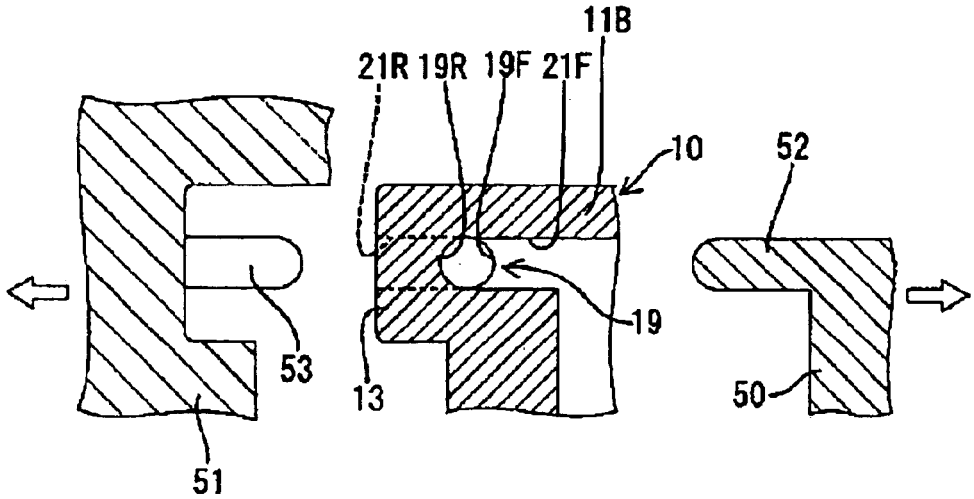
FIG. 5(B) is a sectional plan view of the portion around the horizontal-mounting screw hole with the molds opened.

Each terminal fitting 30S, 31S, 30L, 31L is formed from a long narrow electrically conductive (metallic) plate and has a terminal connecting portion 32 at one end. The terminal connecting portion 32 projects into the receptacle 11 and is configured for connection substantially along a connecting direction CD with a female terminal fitting (not shown) in a female connector. Each terminal fitting 30S, 31S, 30L, 31L has a circuit board connecting portion 33 at the end opposite the terminal connecting portion 32. The circuit board connecting portion 33 is inserted through a terminal insertion hole 41 that penetrates the circuit board P for connection with a corresponding circuit on the circuit board P by soldering, ultrasonic welding, or the like. Each straight terminal fitting 30S, 31S is substantially straight and flat, and each L-shaped terminal fitting 30L, 31L is bent through a right angle at bend 34 to define a substantially L-shape. The straight terminal fittings 31S and the L-shaped terminal fittings 31L are wider than the straight terminal fittings 30S and the L-shaped terminal fittings 30L, and the circuit board connecting portions 33 of these wider terminal fittings 31S, 31L are forked, as shown in FIG. 4. Press-fitted projections (not shown) bulge laterally from the opposite sides of each of the terminal fittings 30S, 31S, 30L, 31L. The press-fitted projections bite in the inner walls of the terminal mount holes 12A, 12B to lock the terminal fittings 30S, 31S, 30L, 31L in the terminal mount holes 12A, 12B.

Two long narrow vertically aligned rear bulges 13 bulge back from the opposite left and right ends of the back wall 11A of the housing 10. Each rear bulge 13 has a substantially round vertical-mounting screw hole 14 that extends forward substantially along the connecting direction CD for a specified depth. Further, each rear bulge 13 has an escaping groove 16 (FIG. 3) at a position near the laterally outermost one of the terminal mount holes 12B. The opening edge of the terminal mount hole 12B may be widened in response to a force exerted while pressing the terminal fitting 31S, 31L into the terminal mount hole 12B. However, this widened portion escapes into the escaping groove 16 to prevent deformation of the rear bulge 13. Two rotation-preventing projections 17 are formed on the back wall 11A of the housing 10 at positions above or near the rear bulges 13 and project further backward than the rear bulges 13. The rotation-preventing projections 17 are engageable with engaging holes 44 that penetrate the circuit board P when the housing 10 is mounted vertically with the terminal connecting portion 32 arranged substantially normal to the circuit board P (FIG. 1). Thus the housing 10 is prevented from rotating along the surface of the circuit board P.

Figure 3:
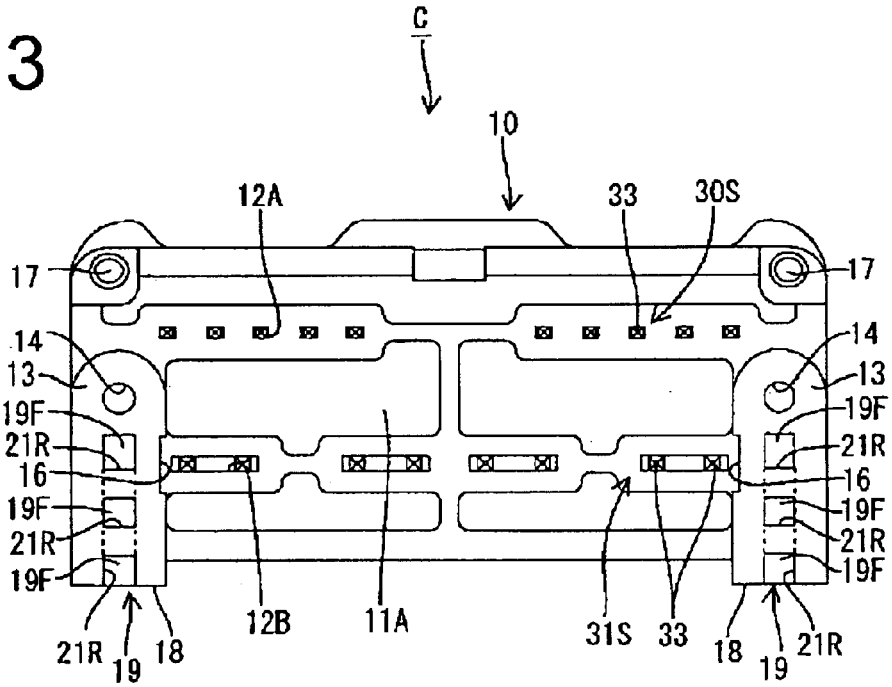
FIG. 3 is a rear view of the connector.

Two lower bulges 18 are formed on the bottom surface of the receptacle 11 and extend between the bottom ends of the rear bulges 13 and the front end of the receptacle 11. The lower bulges 18 bulge down in a direction substantially normal to the bulging direction of the rear bulges 13. The back wall 11 of the receptacle 11 has horizontal-mounting screw holes 19 that open in the bottom surfaces of the lower bulges 18 and extend substantially normal to the connecting direction CD from positions below the vertical-mounting screw holes 14 in the rear bulges 13. Each horizontal-mounting screw hole 19 extends substantially normal to the arranging direction of the terminal mount holes 12B and is between a side wall 11B of the receptacle 11 and the terminal mount hole 12B nearest the side wall 11B. More specifically, each horizontal-mounting screw hole 19 is formed with front and rear inner semicircular walls 19F and 19R. The front inner semicircular walls 19F face rear mold-removal holes 21R that extend forwardly into the screw hole 19. The rear inner semicircular walls 19R face front mold-removal holes 21F that extend rearwardly into the screw hole 19. The front and rear inner semicircular walls 19F and 19R are arranged alternately along the vertical direction, as shown in FIGS. 3 and 6. As shown in FIG. 6, the housing 10 is fixed horizontally to the circuit board P by screwing screws 46 through screw insertion holes 45 in the circuit board P at least partly into the horizontal-mounting screw holes 19 so that the lower bulges 18 closely contact the circuit board P and so that the connecting direction CD is substantially parallel to the circuit board P.

The housing 10 is molded by a front mold 50 and a rear mold 51 that can be opened and closed with respect to each other substantially along the connecting direction CD of the receptacle 11. The front mold 50 has pins 52 with leading ends of an arcuate cross section arranged substantially one over another and projecting back toward the back wall 11A of the housing 10. The rear mold 51 likewise has pins 53 with leading ends of an arcuate cross section arranged substantially one over another and projecting forward toward the open side of the receptacle 11. The front and rear molds 50 and 51 are closed, and the leading ends of the respective pins 52, 53 are placed alternately substantially one over another. A molten resin then is filled into a molding space S defined between the front mold 50 and the rear mold 51. The molds 50, 51 are moved forward and backward to open the mold cavity after the resin has cured, and the completed housing 10 is removed. In this way, the rear inner semicircular walls 19R are formed at the front ends of the mold-removal holes 21F by removing the pins 52 and the front inner semicircular walls 19F are formed at the rear ends of the mold-removal holes 21R by removing the pins 53. The front and rear inner semicircular walls 19F and 19R thus formed are arranged alternately substantially one over another. As a result, the horizontal-mounting screw hole 19, is substantially round when viewed from below.

The type of the terminal fittings, 30S, 31S, 30L, 31L to be used for the connector C is selected according to the mounting orientation of the housing 10 on the circuit board P. Thus, the straight terminal fittings 30S, 31S are pressed into the corresponding terminal mount holes 12A, 12B from the front when the housing 10 is to be mounted vertically with the connecting direction CD substantially normal to the circuit board P, as shown in FIG. 1. The circuit board connecting portion 33 of each straight terminal fitting 30S, 31S is inserted through the corresponding terminal insertion hole 41 of the circuit board P. Additionally, the rotation preventing projections 17 are fit into the engaging holes 44 of the circuit board P and the rear bulges 13 closely contact the circuit board P. Subsequently, the screws 43 are inserted through the screw insertion holes 42 from the rear side of the circuit board P and are screwed into the vertical mounting screw holes 14. At this time, the rotation preventing projections 17 are in the engaging holes 44 of the circuit board P. Thus, the housing 10 is prevented from rotating about the axes of the screws 43, and the mounting operation is performed smoothly. Finally, the circuit board connecting portion 33 of each straight terminal fitting 30S, 31S is connected with the corresponding circuit on the circuit board P by soldering or the like. In this way, the housing 10 is fixed vertically to the circuit board P with the connecting direction CD substantially normal to the circuit board P.

The housing 10 also can be mounted horizontally on the circuit board P with the connecting direction CD substantially parallel to the circuit board P, as shown in FIG. 6. In this situation, the L-shaped terminal fittings 30L, 31L, are pressed into the terminal mount holes 12A, 12B of the housing 10 from the front before being bent into L-shape. The terminal fittings 30L, 31L then are bent down substantially at right angles at specified position behind the housing 10. The housing 10 then is mounted on the circuit board P. Thus, the circuit board connecting portion 33 of each L-shaped terminal fitting 30L, 31L is inserted through the corresponding terminal insertion hole 41 of the circuit board P, and the lower bulges 18 closely contact the circuit board P. Subsequently, the screws 46 are inserted through the screw insertion holes 45 from the rear side of the circuit board P and are screwed into the horizontal-mounting screw holes 19. The external threads of the screws 46 bite into the front inner semicircular walls 19F and the rear inner semicircular walls 19R of the horizontal-mounting screw holes 19, thereby securing the housing 10 to the circuit board P. Finally, the circuit board connecting portion 33 of each L-shaped terminal fitting 30L, 31L is connected with the corresponding circuit on the circuit board P by soldering or the like. In this way, the housing 10 is fixed horizontally to the circuit board P with the connecting direction CD substantially parallel to the circuit board P, as shown in FIG. 6.

According to the invention, the housing 10 can be mounted either horizontally or vertically on the circuit board P. As a result, flexibility in the use of the housing 10 can be improved and costs can be reduced.

The horizontal-mounting screw holes 19 are substantially at middle positions between the sidewalls 11B of the receptacle 11 and the outermost terminal mount holes 12B in the back wall 11A of the receptacle 11. A wall with a certain thickness must be provided around the screw hole to ensure strength. However, the width of the housing 1 is made larger if the mounting portions 4 formed with the screw holes 4A are formed outside the receptacle 3, as in the prior art. Similarly, the width between the terminal mount holes must be wider if the screw hole is formed between a pair of the terminal mount holes in the back wall of the receptacle since a certain clearance is required to be defined between the screw hole and the terminal mount holes, and the dimension of the housing becomes larger. However, in the subject invention, each horizontal-mounting screw hole 19 is near the corresponding sidewall 11B of the receptacle 11. Therefore, a part of the wall around the horizontal-mounting screw hole 19 overlaps the sidewall 11B with respect to widthwise direction. As a result, the width of the housing 10 is smaller by at least as much as the thickness of the sidewall 11B.

The horizontal-mounting screw holes 19 are formed by molds 50, 51 that move substantially along the connecting direction CD. Thus, there is no need to prepare separate molds movable along directions normal to the connecting direction CD to form the horizontal-mounting screw holes 19, and costs are lower.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

Although the screw is directly screwed into each screw hole in the foregoing embodiment, it may be inserted through the screw hole and tightened using a nut.

What is claimed is:

1. A connector for a circuit board, comprising:

a housing with a receptacle into which a mating connector is fittable, the receptacle having a back wall, the housing being mountable on a circuit board;

a first orientation screw hole formed in the housing and extending along a direction at an angle to a connecting direction of the housing for securing the housing to the circuit board in a first orientation;

a second orientation screw hole formed in the housing for securing the housing to the circuit board in a second orientation different from the first orientation;

at least one terminal mount hole penetrating the back wall of the receptacle and into which at least two kinds of terminal fittings are selectively mountable; and wherein the first orientation screw hole is at a substantially middle position between one side wall of the receptacle and one terminal mount hole located at an outermost side in the back wall of the receptacle.

2. The connector of claim 1, wherein the first orientation screw hole is aligned to secure the housing to the circuit board in the first orientation such that the connecting direction is parallel to the circuit board.

3. The connector of claim 2, wherein the second orientation screw hole is aligned to secure the housing to the circuit board in the second orientation such that the connecting direction is substantially normal to the circuit board.

4. The connector of claim 3, wherein the second orientation screw hole is substantially parallel to the connecting direction.

5. The connector of claim 3, wherein the at least two kinds of terminal fittings comprise a substantially L-shaped terminal fitting connectable with a circuit on the circuit board when the housing is in the first orientation and a substantially straight terminal fitting connectable with the circuit on the circuit board when the housing is in the second orientation.

6. The connector of claim 1, wherein a plurality of the terminal mount holes are arranged along a width direction of the receptacle and are aligned at an angle to the first orientation screw hole.

7. A connector for a circuit board, comprising:

a housing with a receptacle into which a mating connector is fittable, the receptacle having a back wall, the housing being mountable on a circuit board;

a first orientation screw hole formed in the housing and extending along a direction at an angle to a connecting direction of the housing for securing the housing to the circuit board in a first orientation, wherein the first orientation screw hole is formed by first concave arcuate walls formed along a first longitudinal side of the first orientation screw hole and facing mold-removal holes formed in a second longitudinal side of the first orientation screw hole and second concave arcuate walls formed along the second longitudinal side of the first orientation-mounting screw hole facing mold-removal holes formed in the first longitudinal side of the first orientation screw hole, the first and second concave arcuate walls being arranged alternately along a direction aligned at an angle to the connecting direction a second orientation screw hole formed in the housing for orientation different from the first orientation; and at least one terminal mount hole penetrating the back wall of the receptacle and into which at least two kinds of terminal fittings are selectively mountable.

8. A connector for a circuit board, comprising:

a housing with opposite front and rear ends and a receptacle extending into the front end for receiving a mating connector along a connecting direction, the receptacle having a back wall, terminal mount holes penetrating the back wall and aligned substantially parallel to the connecting direction;

a first orientation screw hole formed in the housing and aligned substantially normal to the connecting direction for securing the housing to the circuit board in a first orientation where the connecting direction is substantially parallel to the circuit board, wherein the first orientation screw hole is formed by front concave arcuate walls farmed along a front longitudinal side of the first orientation screw hole and facing rear mold-removal holes formed in a rear longitudinal side of the first orientation screw hole and rear concave arcuate walls formed along the rear longitudinal side of the first orientation-mounting screw hole facing front mold-removal holes formed in the front longitudinal side of the first orientation screw hole, the front and rear concave arcuate walls being arranged alternately along a direction aligned normal to the connecting direction; and a second orientation screw hole formed in the housing and extending substantially parallel to the connecting direction for securing the housing to the circuit board in a second orientation where the connecting direction is substantially normal to the circuit board.

9. A method of forming a connector for a circuit board having a housing with a receptacle into which a mating connector is fittable, and mountable on a circuit board by screwing, comprising the following steps;

forming a first orientation screw hole in the housing to extend at an angle to a connecting direction of the housing for securing the housing to the circuit board in a first orientation;

forming a second orientation screw hole in the housing for securing the housing to the circuit board in a second orientation different from the first orientation;

forming at least one terminal mount hole so as to penetrate a back wall of the receptacle, wherein at least two kinds of terminal fittings are selectively mountable into the at least one terminal mount hole; and wherein the first orientation-mounting screw hole is at a substantially middle position between one side wall of the receptacle and one terminal mount hole located at an outermost side in the back wall of the receptacle.

10. The method of claim 9, wherein the first orientation screw hole is aligned to secure the housing to the circuit board such that the connecting direction is parallel to the circuit board.

11. The method of claim 10, wherein the second orientation screw hole is aligned to secure the housing to the circuit board such that the connecting direction is substantially normal to the circuit board.

12. The method of claim 11, wherein the second orientation screw hole is substantially parallel to the connecting direction.

13. The method of claim 9, wherein at least one of the terminal mount holes is aligned an angle to the extension of the first orientation screw hole.

14. A method of forming a connector for a circuit board having a housing with a receptacle into which a mating connector is fittable, and mountable on a circuit board by screwing, comprising the following steps;

forming a first orientation screw hole in the housing to extend at an angle to a connecting direction of the housing for securing the housing to the circuit board in a first orientation, wherein the first orientation screw hole is formed such that inner circumferential walls at one side of the first orientation screw hole substantially along the connecting direction substantially face mold-removal holes formed in the other side of the first orientation screw hole and inner circumferential walls formed at the other side of the first orientation screw hole substantially face mold-removal holes formed in the one side of the first orientation screw hole are alternately aligned at an angle to the connecting direction;

forming a second orientation screw hole in the housing for securing the housing to the circuit board in a second orientation different from the first orientation; and forming at least one terminal mount hole so as to penetrate a back wall of the receptacle, wherein at least two kinds of terminal fittings are selectively mountable into the at least one terminal mount hole.

15. The method of claim 9, wherein the housing is formed by two molds that are closeable substantially along the connecting direction, wherein the molds are formed with at least one pin respectively for forming the inner circumferential walls of the first orientation-mounting screw hole.

16. The method of claim 15, wherein the pins on one mold are arranged alternately with the pins on the other mold.

* * * * *